US007320286B2

(12) United States Patent
Karmazyn

(10) Patent No.: US 7,320,286 B2
(45) Date of Patent: Jan. 22, 2008

(54) SETBACK SWITCH FOR SAFE AND ARM

(75) Inventor: Michael J. Karmazyn, Baltimore, MD (US)

(73) Assignee: AAI Corporation, Hunt Valley, MD (US)

( * ) Notice: Subject to any disclaimer, the term of this patent is extended or adjusted under 35 U.S.C. 154(b) by 547 days.

(21) Appl. No.: 10/965,726

(22) Filed: Oct. 18, 2004

(65) Prior Publication Data

US 2007/0295233 A1 Dec. 27, 2007

(51) Int. Cl.
*F42C 15/24* (2006.01)

(52) U.S. Cl. ..... 102/251; 102/216; 102/247

(58) Field of Classification Search ..... 102/251, 102/216, 247

See application file for complete search history.

(56) References Cited

U.S. PATENT DOCUMENTS 3,580,176 A * 5/1971 Boswell ..... 102/222
3,685,452 A * 8/1972 Held ..... 102/216
4,174,666 A 11/1979 Lucey, Jr. et al.
4,417,519 A 11/1983 Lutz
4,603,635 A 8/1986 Boudreau
4,715,281 A * 12/1987 Dinger et al. ..... 102/216
4,815,381 A * 3/1989 Bullard ..... 102/247
5,012,740 A * 5/1991 Hardt ..... 102/216
5,249,526 A * 10/1993 Cooksey ..... 102/255
5,271,327 A * 12/1993 Filo et al. ..... 102/207
5,705,767 A 1/1998 Robinson
6,064,013 A 5/2000 Robinson
6,167,809 B1 1/2001 Robinson et al.
6,314,887 B1 11/2001 Robinson
6,321,654 B1 11/2001 Robinson
6,568,329 B1 5/2003 Robinson
7,258,068 B2 * 8/2007 Worthington ..... 102/256

* cited by examiner

*Primary Examiner*—Michelle Clement
(74) *Attorney, Agent, or Firm*—Venable LLP; Ralph P. Albrecht

(57) ABSTRACT

A switch mechanism is provided that has a tubular enclosure; a contact pin electrically insulated from the tubular enclosure; a g-weight positioned inside the tubular enclosure and movable from an open position to a closed position; and a transparent closure that encloses one end of the tubular enclosure. The g-weight is in electrical contact with the contact pin and the tubular enclosure when the g-weight is in the closed position, such that a continuous electrical path exists from the contact pin to the tubular enclosure. The g-weight is for moving from the open position to the closed position when the switch mechanism is subjected to an acceleration greater than a threshold acceleration. The g-weight is visible through the transparent closure such that the position of the g-weight can be determined without removing the transparent closure from the tubular enclosure.

18 Claims, 7 Drawing Sheets

SETBACK SWITCH FOR SAFE AND ARM

BACKGROUND OF THE INVENTION

The invention relates to electrical switches. More particularly, the invention relates to switches that are actuated by acceleration. Even more particularly, the invention relates to switches for arming a projectile in which the actuation of the switch results from the launch acceleration of the projectile.

It is often desirable to make energetic devices such that they can be stored in a disarmed state and armed only upon launching. For example, it is often desirable for an explosive projectile to be armed when it is launched by, for example, an acceleration activated switch. Such switches are known as "g-switches".

G-switches must be reliable in several ways. First, a g-switch must maintain its unarmed position until it is launched. Also, a g-switch must reliably move from the unarmed position to the armed position upon a pre-determined event such as, in this example, launch of the projectile. Finally, a g-switch, in most cases, must reliably stay in the armed position once it is placed in the armed position.

SUMMARY OF THE INVENTION

An embodiment of the invention provides a switch mechanism having a tubular enclosure; a contact pin electrically insulated from the tubular enclosure; a g-weight positioned inside the tubular enclosure and movable from an open position to a closed position; and a transparent closure that encloses one end of the tubular enclosure. The g-weight is in electrical contact with the contact pin and the tubular enclosure when the g-weight is in the closed position, such that a continuous electrical path exists from the contact pin to the tubular enclosure. The g-weight is for moving from the open position to the closed position when the switch mechanism is subjected to an acceleration greater than a threshold acceleration. The g-weight is visible through the transparent closure such that the position of the g-weight can be determined without removing the transparent closure from the tubular enclosure.

BRIEF DESCRIPTION OF THE DRAWINGS

Further advantages and details of the invention follow from the exemplary embodiments and are explained in the following with the aid of the Figures, in which.

DETAILED DESCRIPTION OF THE INVENTION

The invention will be described using the example of an acceleration actuated switch for use with an explosive projectile. It is noted however that the invention can also be applied to other acceleration activated switching applications.

In this example, for safe handling and transportation, it is desirable for the switch to stay in the unarmed, or open, position when subjected to acceleration of approximately 8000 times the acceleration of gravity ("g's"). Also, it is desirable for the switch to reliably move to the armed or closed position when subjected to 25,000 g's or more. Many applications for the invention involve acceleration on the order of 65,000 to 75,000 g's, providing a significant margin above the switching acceleration needed in this example. The invention also provides a reliable mechanism for maintaining the armed or closed position once that position has been reached. Breaks in the electrical contact caused by the switch moving to the closed position are most always undesirable.

While particular g-load levels are discussed above as an example, it is noted that the stated figures can be increased or decreased by strategic changes in the design in order to meet a variety of criteria such as, for example, increasing or decreasing the mass of the g weight and/or increasing or decreasing the size or strength or the sheer feature of the switch. Changes in the type or properties of materials used in the switch can affect the desired retention and deployment properties of the g-weight.

The invention provides a small switch that includes a g-weight that, when subjected to a threshold acceleration, moves from an open position to a closed position. When the g-weight reaches the closed position, an electrical circuit is completed and, in this example, the explosive projectile is armed.

In particular embodiments of the invention, the g-weight has a sheer feature that dictates how much force the weight can resist before breaking and moving to the closed position. The geometry of the g-weight is such that it locks onto a switch terminal upon movement into the closed position. In some embodiments, the g-weight is designed to also spread outwardly as it engages the switch terminal such that the outside of the g-weight is wedged against the switch housing. These features help ensure that the g-weight stay in the closed position after it reaches the closed position.

Figure 1:
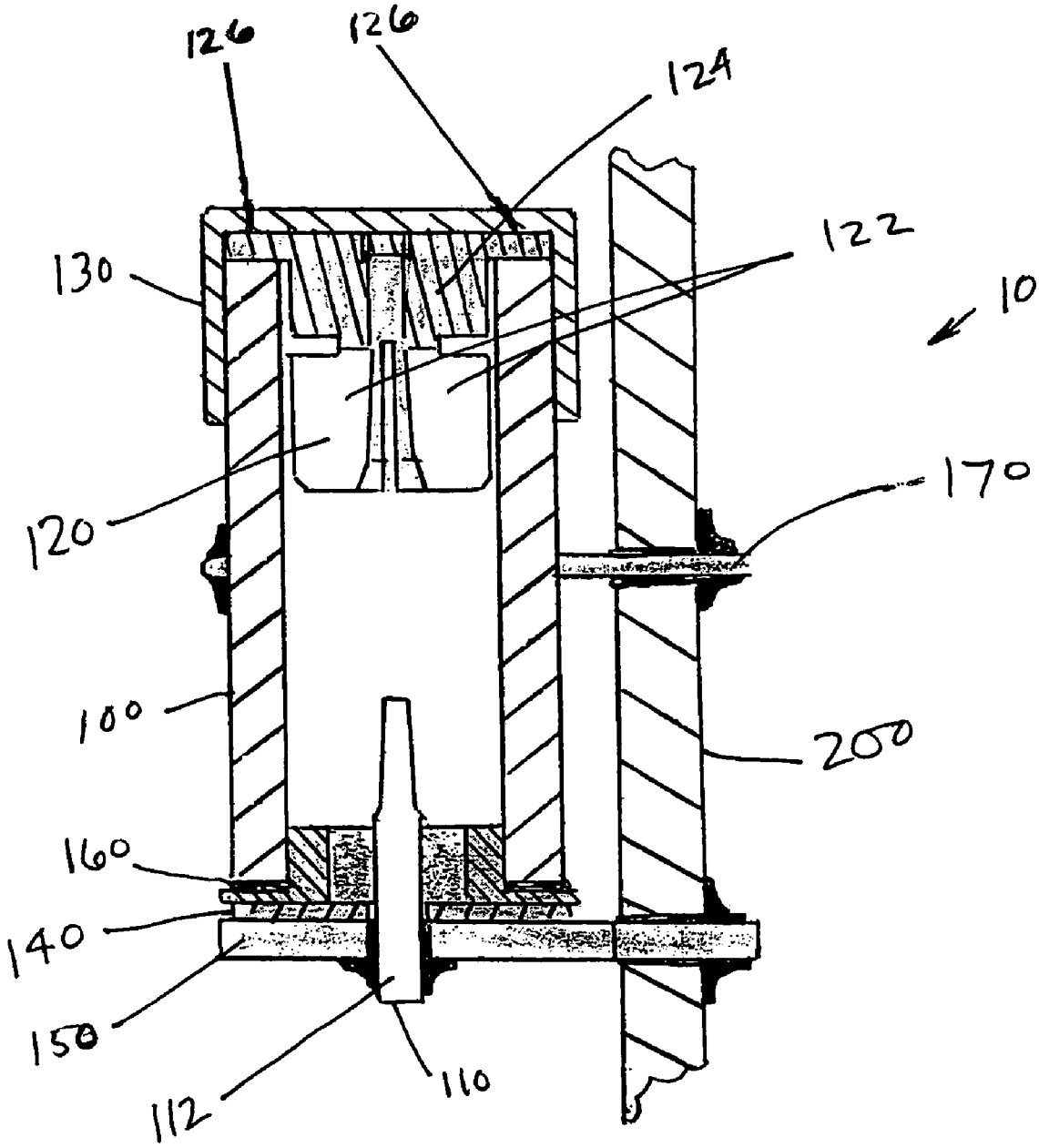
FIG. 1 is a cross section of an embodiment of the invention in the open or unarmed state.

An example of the invention is shown in the figures. FIG. 1 shows a switch mechanism 10 having a tubular enclosure 100 mounted to a printed circuit board 200. Tubular enclosure 100 acts as the main body of switch mechanism 10 and houses a switch terminal 110 and a g-weight 120. FIG. 1 shows switch mechanism 10 in the open position. Switch mechanism 10 is used as part of an electrical circuit for, in this example, the arming mechanism of an explosive projectile. G-weight 120 has a number of pedals 122 attached to an upper body 124 which, in turn, is attached to a number of breakable legs 126.

Switch terminal 110 is position at one end of tubular enclosure 100 and is electrically connected to a terminal 150 that is attached to printed circuit board 200. An insulating disk 140 is positioned between terminal lug 150 and tubular enclosure 100 to prevent electrical contact between terminal lug 150 and tubular enclosure 100. A preformed solder ring 160 is used to solder tubular enclosure 100 to switch terminal 110. Preformed solder ring 160 provides the benefit of a controlled solder deposit, unlike the uncontrolled deposit of solder that can result from conventional soldering techniques.

Switch terminal 110 includes a contact pin 112 that is electrically insulated from tubular enclosure 100 (in the open position). A housing wire 170 is electrically connected to tubular enclosure 100 and is for connecting to the appropriate circuit for arming the explosive projectile.

A transparent closure 130 is provided at the end of tubular enclosure 100 opposite switch terminal 110. The transparent nature of transparent closure 130 allows visual inspection of the position of the g-weight without disassembling switch mechanism 10. In particular embodiments, transparent closure 130 is removable. One advantage of a removable transparent closure 130 is that it allows replacement of g-weight 120 with a g-weight of different mass, material or configuration. As stated previously, changing the mass, material or configuration of the g-weight can alter the threshold acceleration required to move the g-weight from the open position to the closed position. As a result, having a removable transparent closure 130 allows the operation threshold of switch mechanism 10 to be readily changed to suit various acceleration thresholds.

Figure 2:
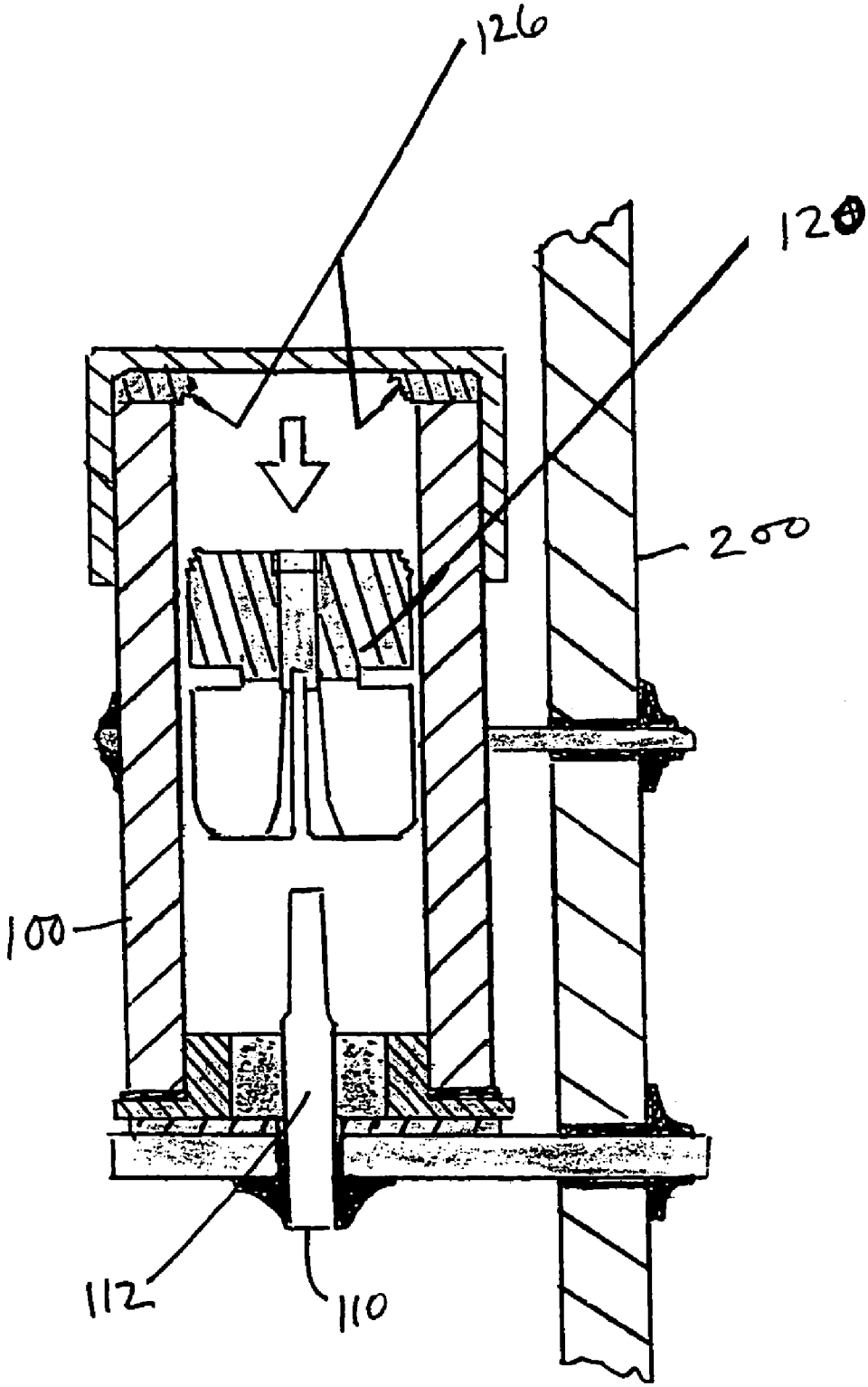
FIG. 2 is a cross section of the embodiment shown in FIG. 1 in transition from the open or unarmed state to the closed or armed state.

When subjected to acceleration greater than the predetermined threshold acceleration, breakable legs 126 sheer due to their inability to transfer the acceleration to g-weight 120. As a result, g-weight 120 does not accelerate as quickly as switch mechanism 10 and, therefore, moves relative to tubular enclosure 100 in the direction of contact pin 112. FIG. 2 shows g-weight 120 during its movement from the open position to the closed position in which it engages contact pin 112.

Figure 3:
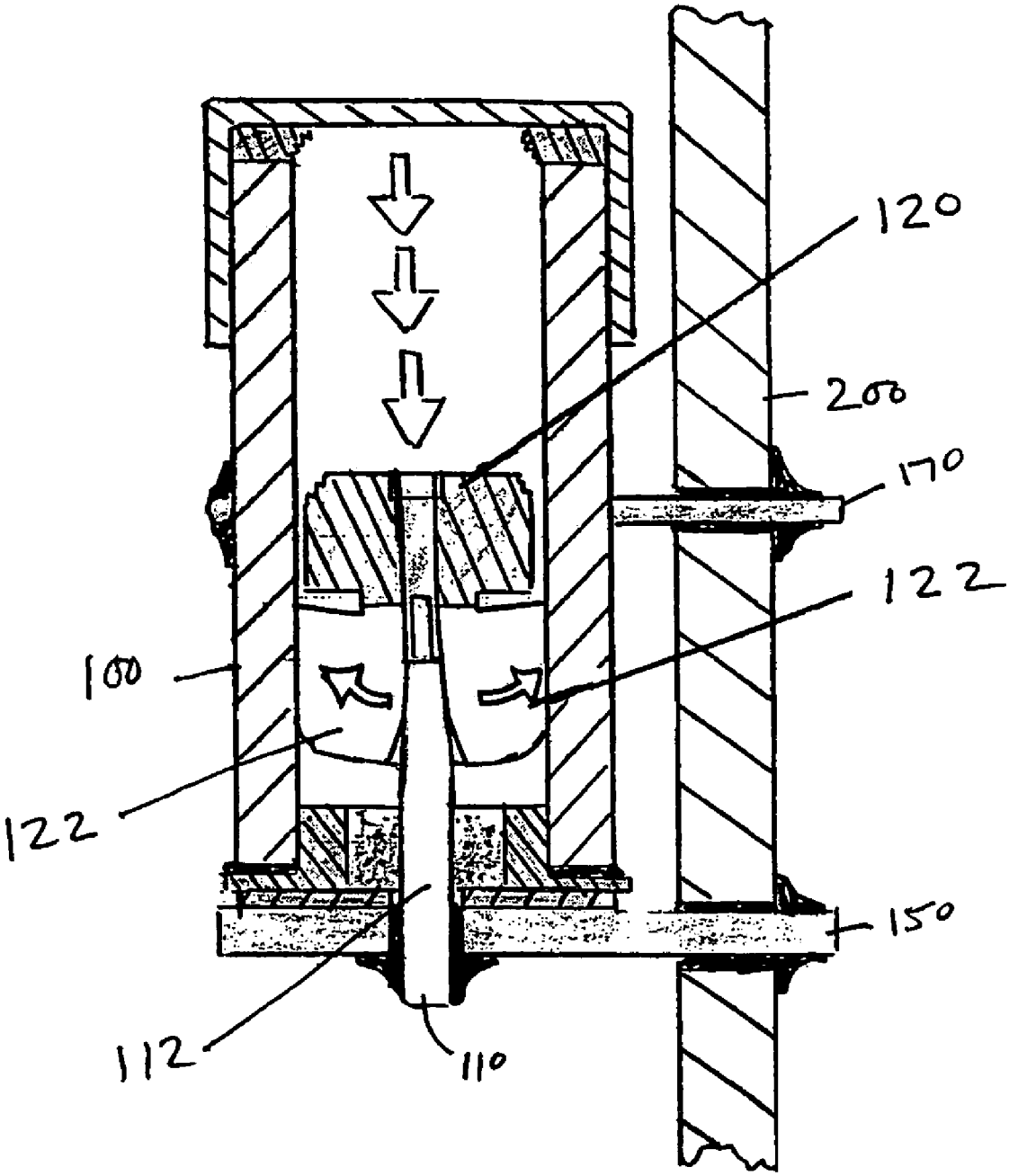
FIG. 3 is a cross section of the embodiment shown in FIGS. 1 and 2 in the closed or armed state.

FIG. 3 shows switch mechanism 10 in the closed position. In this figure, g-weight 120 has moved relative to tubular enclosure 100 such that pedals 122 have been wedged between contact pin 112 and the inner walls of tubular enclosure 100, completing the circuit between tubular enclosure 100 and contact pin 112 and, therefore, housing wire 170 and terminal lug 150. A reliable closed circuit is maintained by the pedals 122 being securely wedged between tubular enclosure 100 and contact pin 112. The shape of pedals 122 and the deformability of the material used for pedals 122 are important in securing g-weight 120 in the closed position.

In particular embodiments of the invention, g-weight 120 and/or tubular enclosure 100 are gold plated brass to facilitate maintenance of electrical integrity after being subjected to long periods of storage. It is noted, however, that other electrically conductive materials can also be used.

Figure 4:
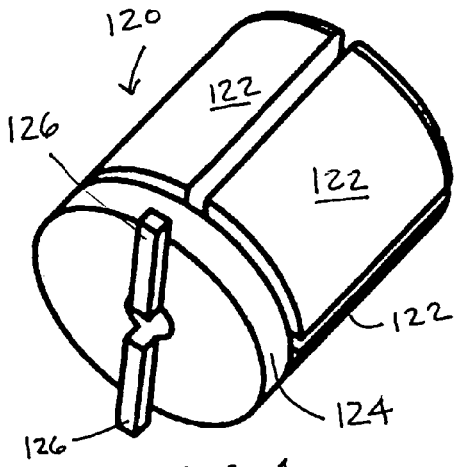
FIG. 4 is a perspective view of a g-weight in accordance with the invention.
Figure 5:
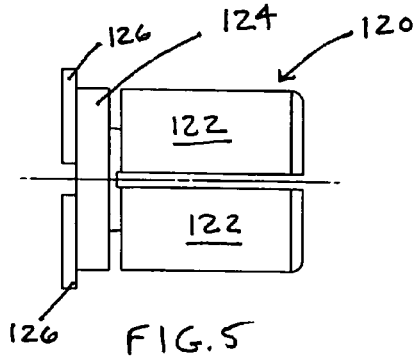
FIG. 5 is a side view of the g-weight.
Figure 6:
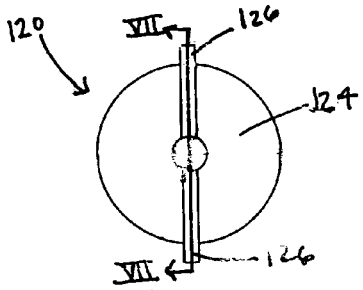
FIG. 6 is a left end view of the g-weight.

FIGS. 4-9 show detailed views of g-weight 120. FIG. 4 is a perspective view of g-weight 120 showing how breakable legs 126 extend pass the outer circumference of upper body 124, creating the sheer feature that allows g-weight 120 to move from the open position to the closed position when subjected to a predetermined threshold acceleration. Also, three of the four pedals 122 are shown with the gaps formed there between. It can be seen in FIG. 5 that the gap between two adjacent pedals 122 extends radially completely through g-weight 120. This is also shown in the section view (FIG. 7) of FIG. 6.

Figure 7:
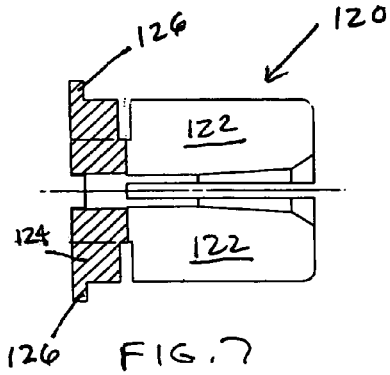
FIG. 7 is a cross section along section line VII-VII in FIG. 6.
Figure 8:
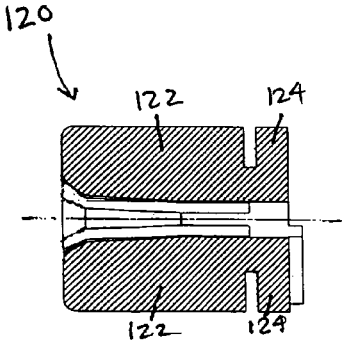
FIG. 8 is a cross section along section line VIII-VIII in FIG. 9.

G-weight 120 has a tapered central void that receives a preferably tapered contact pin 112 when g-weight 120 moves into the closed position. FIGS. 7 and 8 show the tapered nature of the central void. Because the central void is tapered, pedals 122 are forced outward radially when contact pin 112 engages g-weight 120. The tapered void of g-weight 120 is formed to have a broader entrance, and is also fashioned significantly longer than an engagable portion of tapered contact pin 112 so ease of engagement and positive engagement between g-weight 120 and contact pin 112 is facilitated, and to prevent g-weight 120 from "dead ending" or bouncing off switch terminal 110. Furthermore, taper-to-taper seating facilitates a desired jamming action, thereby enhancing the ability of the switch to remain in the closed position once engaged.

Figure 9:
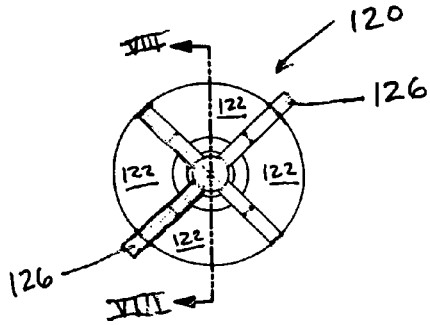
FIG. 9 is a right end view of the g-weight.

The outward movement of pedals 122 is facilitated by the reduced diameter of the section of g-weight 120 that connects pedals 122 to upper body 124, as shown in FIG. 8 (which is a section of FIG. 9).

Figure 10:
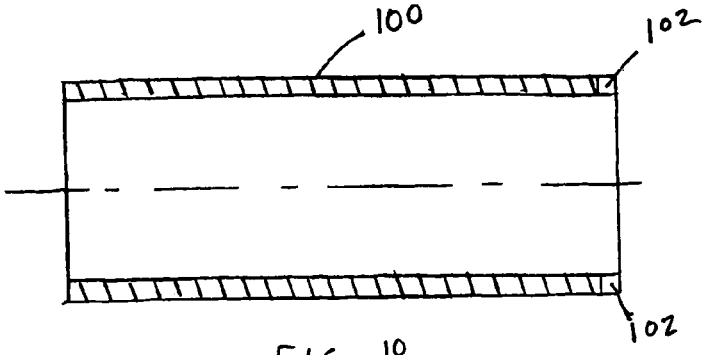
FIG. 10 is a cross section of a tubular housing in accordance with the invention.
Figure 11:
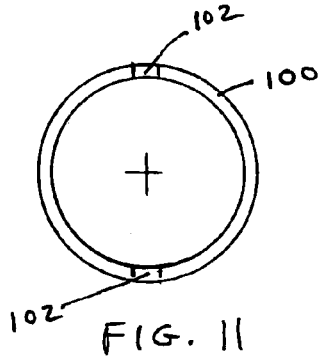
FIG. 11 is an end view of the tubular housing.
Figure 12:
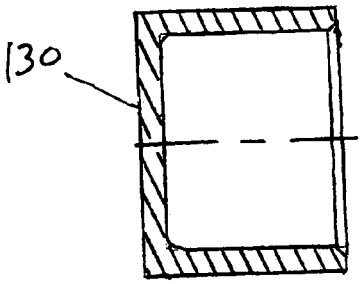
FIG. 12 is a cross section of a transparent closure in accordance with the invention.
Figure 13:
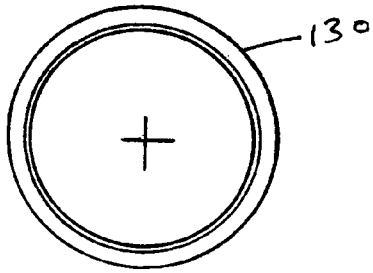
FIG. 13 is an end view of the transparent closure.
Figure 14:
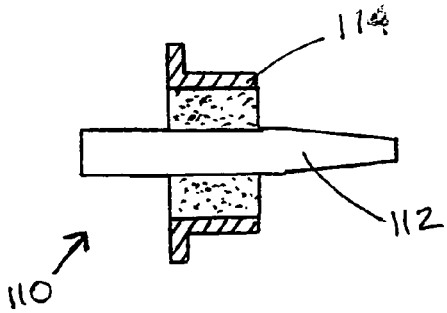
FIG. 14 is a cross section of a switch terminal in accordance with the invention.

FIGS. 10 and 11 show tubular enclosure 100. Tubular enclosure 100 is, in this example, provided with two recesses 102 for receiving the ends of breakable legs 126 of g-weight 120. FIGS. 12 and 13 show transparent closure 130 in a sectional view and an open end view, respectively. FIG. 14 shows switch terminal 110 having an outer ring 114 and an electrically insulating material between outer ring 114 and contact pin 112.

Figure 15:
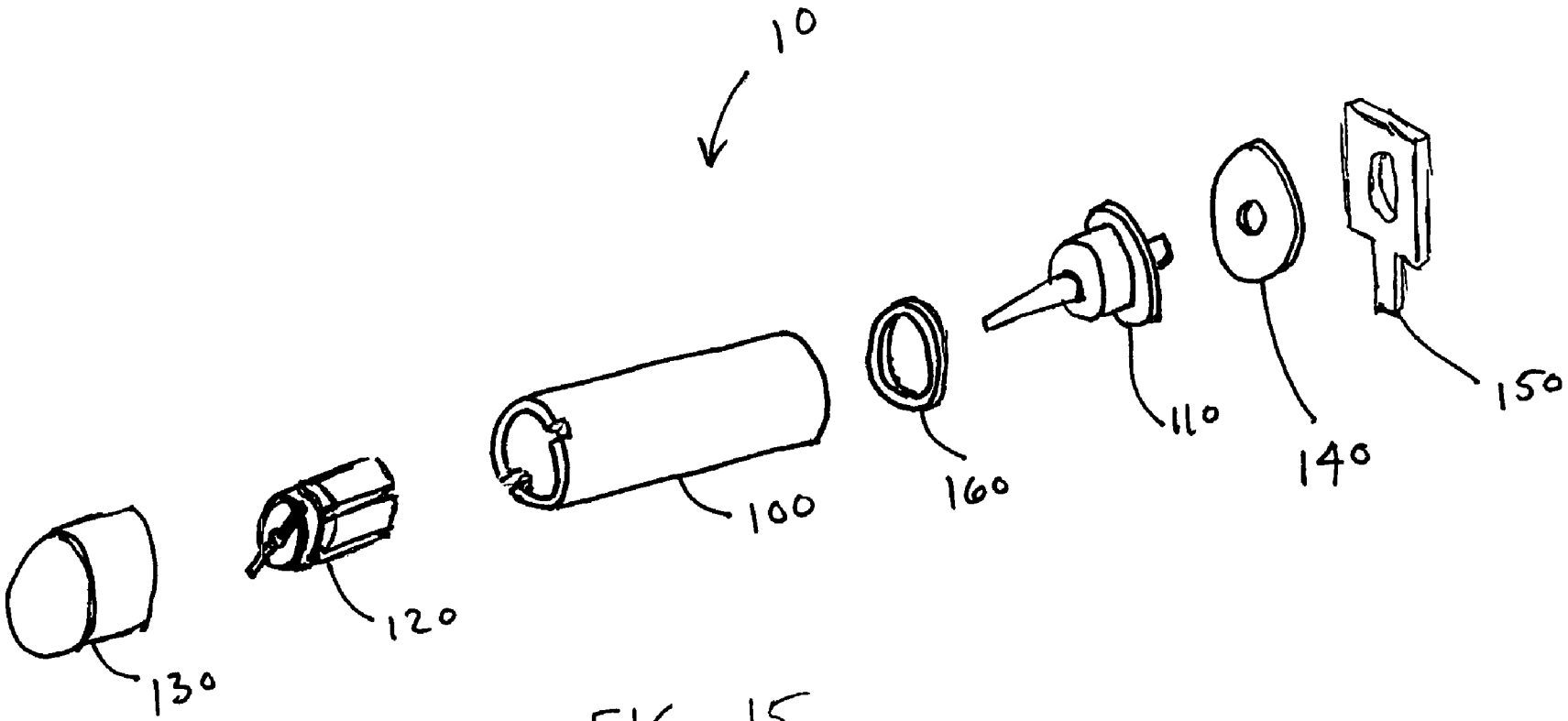
FIG. 15 is an exploded view of a switch in accordance with the invention.
Figure 16:
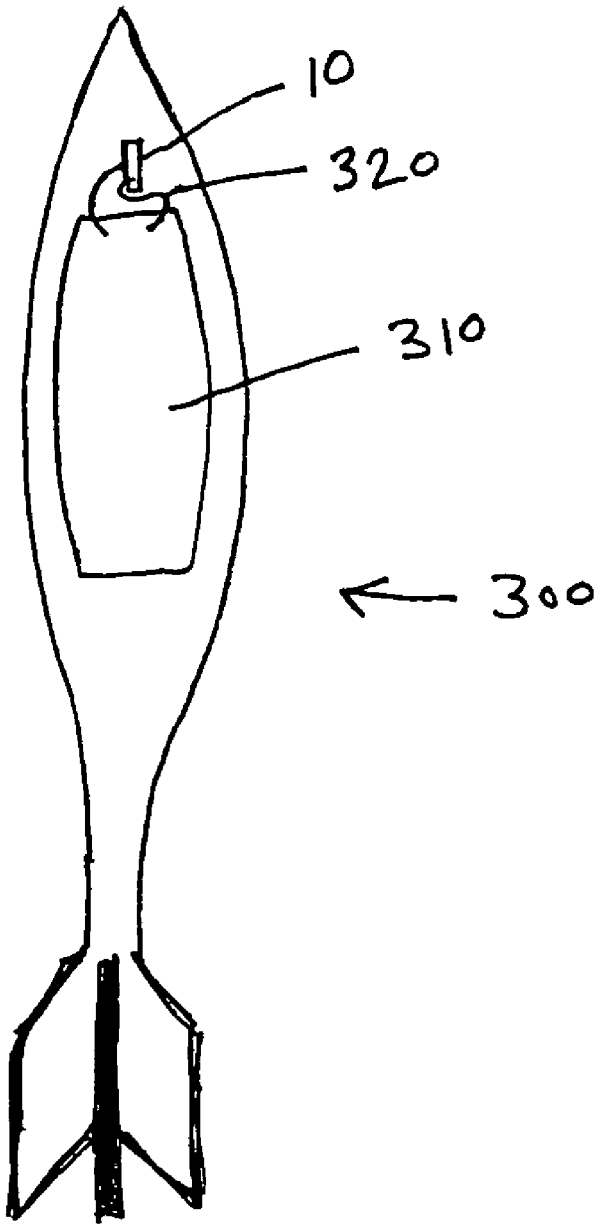
FIG. 16 shows a projectile in accordance with the invention.

FIG. 15 shows an exploded view of switch mechanism 100. FIG. 16 shows a projectile 300 in accordance with an embodiment of the invention. Projectile 300 has an explosive portion 310 and an arming electrical circuit 320 connected to explosive portion 310. Switch mechanism 10 is apart of arming circuit 320. Explosive portion 310 can readily be substituted with an energetic thruster, pyrotechnic gas generator, explosive staging device, etc.

The invention is not limited to the above-described exemplary embodiments. It will be apparent, based on this disclosure, to one of ordinary skill in the art that many changes and modifications can be made to the invention without departing from the spirit and scope thereof.

What is claimed is:

1. A switch mechanism, comprising:

a tubular enclosure;

a contact pin electrically insulated from the tubular enclosure;

a g-weight positioned inside the tubular enclosure and movable from an open position to a closed position; and a transparent closure that encloses one end of the tubular enclosure, wherein the g-weight is in electrical contact with the contact pin and the tubular enclosure when the g-weight is in the closed position, such that a continuous electrical path exists from the contact pin to the tubular enclosure, the g-weight is for moving from the open position to the closed position when the switch mechanism is subjected to an acceleration greater than a threshold acceleration, and the g-weight is visible through the transparent closure such that the position of the g-weight can be determined without removing the transparent closure from the tubular enclosure.

2. The mechanism of claim 1, wherein the contact pin is a tapered contact pin.

3. The mechanism of claim 2, further comprising at least one breakable member attached to the g-weight, the breakable member holding the g-weight in the open position when subjected to an acceleration less than the threshold acceleration, and being for breaking and allowing the g-weight to travel from the open position to the closed position when subjected to an acceleration greater than the threshold acceleration.

4. The mechanism of claim 3, wherein the at least one breakable member comprises two breakable members that extend radially from the g-weight and each engage a corresponding recess in the tubular enclosure.

5. The mechanism of claim 4, wherein the g-weight comprises a plurality of petals that electrically contacts the tubular enclosure and the contact pin when the g-weight is in the closed position, the petals are wedged between the tubular enclosure and the contact pin when the g-weight is in the closed position, and the g-weight further comprises a tapered void for receiving the contact pin when the g-weight is in the closed position.

6. The mechanism of claim 1, further comprising a housing wire that is electrically connected to the tubular enclosure and is for electrically connecting to a printed circuit board to which the switch mechanism is to be mounted.

7. The mechanism of claim 1, further comprising a terminal lug that is electrically connected to the contact pin and is for electrically connecting to a printed circuit board to which the switch mechanism is to be mounted.

8. The mechanism of claim 1, wherein the g-weight comprised at least one petal that electrically contacts the tubular enclosure and the contact pin when the g-weight is in the closed position.

9. The mechanism of claim 8, wherein the g-weight comprises a plurality of petals that electrically contacts the tubular enclosure and the contact pin when the g-weight is in the closed position.

10. The mechanism of claim 9, wherein the petals are wedged between the tubular enclosure and the contact pin when the g-weight is in the closed position.

11. The mechanism of claim 10, wherein the g-weight further comprises a tapered void for receiving the contact pin when the g-weight is in the closed position.

12. The mechanism of claim 1, wherein the transparent closure is removable without damaging the removable enclosure or the tubular enclosure.

13. The mechanism of claim 12, wherein the g-weight is removable from the tubular enclosure without damaging the g-weight or the tubular enclosure.

14. The mechanism of claim 1, further comprising a switch terminal that locates the contact pin relative to the tubular enclosure.

15. The mechanism of claim 14, further comprising a preformed solder ring that connects the switch terminal to the tubular enclosure.

16. The mechanism of claim 1, wherein the threshold acceleration is above 25,000 g's.

17. The mechanism of claim 16, wherein the threshold acceleration is between 25,000 g's and 65,000 g's.

18. The mechanism of claim 1, wherein the continuous electrical path is for completing an arming circuit in an explosive or energetically assisted projectile.

* * * * *